US012151335B1

(12) United States Patent
Lu et al.

(10) Patent No.: US 12,151,335 B1
(45) Date of Patent: Nov. 26, 2024

(54) MONITORING METHOD FOR CHEMICAL MECHANICAL POLISHING AND CHEMICAL MECHANICAL POLISHING DEVICE

(71) Applicant: Hwatsing Technology Co., Ltd., Tianjin (CN)

(72) Inventors: Xinchun Lu, Tianjin (CN); Tongqing Wang, Tianjin (CN); Hui Ci, Tianjin (CN); Qingbo Liang, Tianjin (CN); Haiyang Xu, Tianjin (CN); Rui Tan, Tianjin (CN)

(73) Assignee: Hwatsing Technology Co., Ltd., Tianjin (CN)

( * ) Notice: Subject to any disclaimer, the term of this patent is extended or adjusted under 35 U.S.C. 154(b) by 0 days.

(21) Appl. No.: 18/757,631

(22) Filed: Jun. 28, 2024

(30) Foreign Application Priority Data

Feb. 7, 2024 (CN) ..... 202410171461.9

(51) Int. Cl.
*B24B 37/005* (2012.01)
*B24B 53/017* (2012.01)

(52) U.S. Cl.
CPC ..... *B24B 37/005* (2013.01); *B24B 53/017* (2013.01)

(58) Field of Classification Search
CPC ..... B24B 7/228; B24B 37/005; B24B 37/013; B24B 37/07; B24B 37/10; B24B 37/105
See application file for complete search history.

(56) References Cited

U.S. PATENT DOCUMENTS 6,113,462 A * 9/2000 Yang ..... B24B 37/005 451/5
2006/0046619 A1 3/2006 Lin et al.
2010/0081361 A1 4/2010 Fukuda et al.

FOREIGN PATENT DOCUMENTS

| | | | |
|---|---|---|---|
| CN | 110497307 | A | 11/2019 |
| CN | 114536221 | A | 5/2022 |
| CN | 115157005 | A | 10/2022 |
| CN | 115172224 | A | 10/2022 |
| CN | 116209543 | A | 6/2023 |
| CN | 116967926 | A | 10/2023 |

(Continued)

OTHER PUBLICATIONS

First office action of Chinese Application No. 202410171461.9 issued by CNIPA on Mar. 21, 2024.

*Primary Examiner* — Joel D Crandall
(74) *Attorney, Agent, or Firm* — Semicon IP Solutions LLC

(57) ABSTRACT

A monitoring method and a device for chemical mechanical polishing are provided. The method includes: loading a to-be-polished wafer with a carrier, attaching the wafer to a polishing pad on a polishing platen, and supplying slurry between the polishing pad and the wafer with a slurry supply apparatus; conditioning the polishing pad with a conditioner, and obtaining strain data of the conditioner, wherein the conditioner includes a drive arm and a conditioning head, the conditioning head conditions the polishing pad with the support of the drive arm, the drive arm undergoes a strain in response to a force applied by the the conditioning head, and the strain data is used to indicate a strain value of the drive arm; determining a conditioning deviation based on the strain data, and determining a wear state of the polishing pad based on the conditioning deviation.

16 Claims, 6 Drawing Sheets

(56) References Cited

FOREIGN PATENT DOCUMENTS

| | | | |
|---|---|---|---|
| CN | 117381547 | A | 1/2024 |
| JP | H0970753 | A | 3/1997 |
| JP | 2005022028 | A | 1/2005 |

* cited by examiner

MONITORING METHOD FOR CHEMICAL MECHANICAL POLISHING AND CHEMICAL MECHANICAL POLISHING DEVICE

CROSS-REFERENCE TO RELATED APPLICATION

The present disclosure is a continuation of Chinese application No. 202410171461.9 and entitled "MONITORING METHOD FOR CHEMICAL MECHANICAL POLISHING AND CHEMICAL MECHANICAL POLISHING DEVICE", filed on Feb. 7, 2024, which is hereby incorporated by reference in its entirety.

TECHNICAL FIELD

Embodiments of the present disclosure relate to the field of semiconductor manufacturing technologies, and in particular, to a monitoring method for chemical mechanical polishing and a chemical mechanical polishing device.

BACKGROUND

In a chemical mechanical polishing process, to make a polishing pad have a good surface characteristic, a conditioner needs to be used to condition a surface of the polishing pad. In a related technology, a conditioning head and a conditioning plate are usually installed on a drive arm of a conditioner. The conditioner gives a downward pressure and a rotation torque to the conditioning head through the drive arm, so that the conditioning plate of the conditioning head moves on the surface of the polishing pad, to condition the surface of the polishing pad.

A conditioned status of the polishing pad directly affects a polishing effect of a wafer. For example, if the polishing pad is conditioned unevenly in a local area, slurry distribution and a lateral force of the wafer are adversely affected. As a result, a wafer that meets a process requirement cannot be obtained. Therefore, it is very important to monitor the conditioned status of the polishing pad.

SUMMARY

In view of this, embodiments of the present disclosure provide a monitoring method for chemical mechanical polishing and a chemical mechanical polishing device, to at least partially resolve the foregoing problem.

According to a first aspect of the embodiments of the present disclosure, a monitoring method for chemical mechanical polishing is provided, including: loading a to-be-polished wafer with a carrier, attaching the wafer to a polishing pad on a polishing platen, and supplying slurry between the polishing pad and the wafer by using a slurry supply apparatus; conditioning the polishing pad by using a conditioner, and obtaining strain data of the conditioner, where the conditioner includes a drive arm and a conditioning head, the conditioning head conditions the polishing pad with the support of the drive arm, the drive arm generates a strain under an acting force of the conditioning head, and the strain data is used to indicate a strain value of the drive arm; determining a conditioning deviation based on the strain data, where the conditioning deviation is used to indicate flatness of the polishing pad; and determining a wear state of the polishing pad based on the conditioning deviation, and performing chemical mechanical polishing on the wafer.

In a possible implementation, the strain data includes a plurality of strain values of the drive arm that are continuously collected in a process of conditioning the polishing pad by the conditioning head. The determining a conditioning deviation based on the strain data includes: determining the conditioning deviation based on the plurality of strain values included in the strain data.

In a possible implementation, in the process of conditioning the polishing pad by the conditioning head, the drive arm drives the conditioning head to oscillate on the polishing pad, and the strain data includes a plurality of strain values collected in one oscillation cycle of the drive arm.

In a possible implementation, the determining the conditioning deviation based on the plurality of strain values included in the strain data includes: normalizing the plurality of strain values included in the strain data, to obtain the normalization result corresponding to each strain value in the plurality of strain values; and determining the conditioning deviation based on normalization results corresponding to the plurality of strain values.

In a possible implementation, the normalizing the plurality of strain values included in the strain data includes:

calculating, based on the strain value included in the strain data, the normalization result corresponding to the strain value through the following formula:

$$\varepsilon_i^*=(\varepsilon_i-\varepsilon_\min)/(\varepsilon_\max-\varepsilon_\min)$$

In the formula, ε_i is an $i^{th}$ strain value included in the strain data, ε_i* is the normalization result of ε_i, ε_min is a minimum strain value in the plurality of strain values, ε_max is a maximum strain value in the plurality of strain values, and i is a positive integer.

In a possible implementation, the determining the conditioning deviation based on normalization results corresponding to the plurality of strain values includes:

calculating the conditioning deviation through the following formula based on the normalization results corresponding to the plurality of strain values:

$$R=\sum_{i=1}^{n}(\varepsilon_i*/n-0.5)$$

In the formula, R is the conditioning deviation, and n is a quantity of the strain values included in the strain data.

In a possible implementation, the method further includes: when at least one strain value included in the strain data is less than an alert threshold, determining that the polishing pad is approaching end of service life.

In a possible implementation, the method further includes: calculating the alert threshold through the following formula based on a driving force that is output by a drive mechanism in the process of conditioning the polishing pad with the conditioning head and the strock resistance acted on the conditioning plate in the conditioning head at the maximum travel distance:

$$\varepsilon_y=(P-f(L_\max))/k$$

In the formula, ε_y is the alert threshold, P is the driving force that is output by the drive mechanism in the process of conditioning the polishing pad by the conditioning head, f(L_max) is the travel resistance acted on the conditioning plate at the maximum travel distance of the conditioning plate, L_max is the maximum travel distance of the conditioning plate, and k is a correlation coefficient between the strain value and a pressure exerted by the conditioning plate on the polishing pad.

According to a second aspect of the embodiments of the present disclosure, a chemical mechanical polishing device is provided, including a polishing platen, a carrier, a slurry supply apparatus, a conditioner, and a controller. The carrier loads a to-be-polished wafer and attaches the wafer to a polishing pad on the polishing platen, the slurry supply apparatus supplies slurry between the polishing pad and the wafer, the conditioner is configured to condition a surface of the polishing pad, and the controller is configured to perform operations corresponding to the foregoing method.

In a possible implementation, in the process of conditioning the polishing pad by the conditioning head, the drive arm drives the conditioning head to oscillate on the polishing pad, and the strain data includes a plurality of strain values collected in one oscillation cycle of the drive arm.

In the embodiments of the present disclosure, the carrier loads the to-be-polished wafer and attaches the wafer to the polishing pad on the polishing platen, and the slurry supply apparatus supplies the slurry between the polishing pad and the wafer. The conditioner conditions the polishing pad and obtains strain data of the conditioner, the conditioning deviation of the polishing pad may be determined based on a change of the strain data, and a wear state of the polishing pad is determined based on the determined conditioning deviation, to implement monitoring of the polishing pad. Therefore, a case in which the polishing pad is abnormally worn can be alerted in a timely manner when the polishing pad is conditioned, to prevent a polishing effect of the wafer from being affected by abnormal conditioning of the polishing pad, and an attaching force of the carrier to the wafer can be adjusted based on the wear state, so as to perform chemical mechanical polishing on the wafer, thereby improving a polishing accuracy.

BRIEF DESCRIPTION OF THE DRAWINGS

To describe the technical solutions in the embodiments of the present disclosure or in the conventional technology more clearly, the following briefly describes the accompanying drawings for describing the embodiments or the conventional technology. It is clear that the accompanying drawings in the following description are merely some embodiments recorded in the embodiments of the present disclosure, and a person of ordinary skill in the art may still derive other drawings from these accompanying drawings.

DETAILED DESCRIPTION

To enable a person skilled in the art to better understand the technical solutions in the embodiments of the present disclosure, the following clearly describes the technical solutions in the embodiments of the present disclosure with reference to the accompanying drawings in the embodiments of the present disclosure. It is clear that the described embodiments are only a part rather than all of the embodiments of the present disclosure. Based on the embodiments in the embodiments of the present disclosure, all other embodiments obtained by a person of ordinary skill in the art shall fall within the protection scope of the embodiments of the present disclosure.

The terms used in the present disclosure are for the sole purpose of describing specific embodiments and are not intended to limit the present disclosure. The terms "one", "the" and "this" of singular forms used in the present disclosure and the appended claims are also intended to include plural forms, unless otherwise specified in the context clearly. It should be further understood that the term "and/or" used herein indicates and includes any or all possible combinations of one or more associated listed items.

It should be understood that although the terms "first", "second", "third", and the like may be used the present disclosure to describe various types of information, the information should not be limited to these terms. These terms are only used to distinguish between information of a same type. For example, without departing from the scope of the present disclosure, "first information" may also be referred to as "second information", and similarly, "second information" may also be referred to as "first information". Depending on the context, for example, the word "if" used herein can be interpreted as "while", "when", or "in response to determining".

According to a first aspect of the embodiments of the present disclosure, a monitoring method for chemical mechanical polishing is provided, to resolve the foregoing problems.

The following describes in detail, with reference to the accompanying drawings, the monitoring method for chemical mechanical polishing, provided in the embodiments of the present disclosure.

Figure 1:
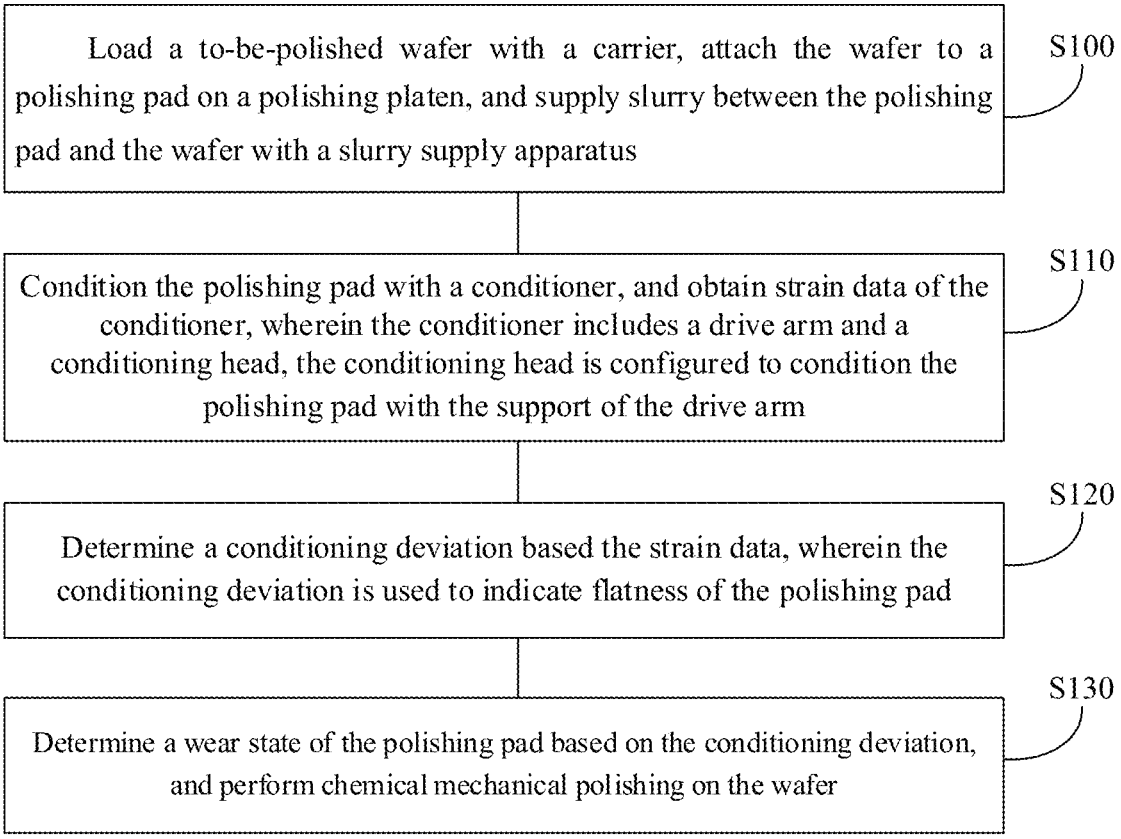
FIG. 1 is a step flowchart of a monitoring method for chemical mechanical polishing according to an embodiment of the present disclosure.

As shown in FIG. 1, an embodiment of the present disclosure provides a monitoring method for chemical mechanical polishing, including:

S100: Load a to-be-polished wafer with a carrier, attach the wafer to a polishing pad on a polishing platen, and supply slurry between the polishing pad and the wafer with a slurry supply apparatus.

S110: Condition the polishing pad with a conditioner, and obtain strain data of the conditioner, wherein the conditioner includes a drive arm and a conditioning head, the conditioning head is configured to condition the polishing pad with the support of the drive arm, the drive arm undergoes a strain in response to an force applied by the conditioning head, and the strain data is used to indicate a strain value of the drive arm.

Figure 2:
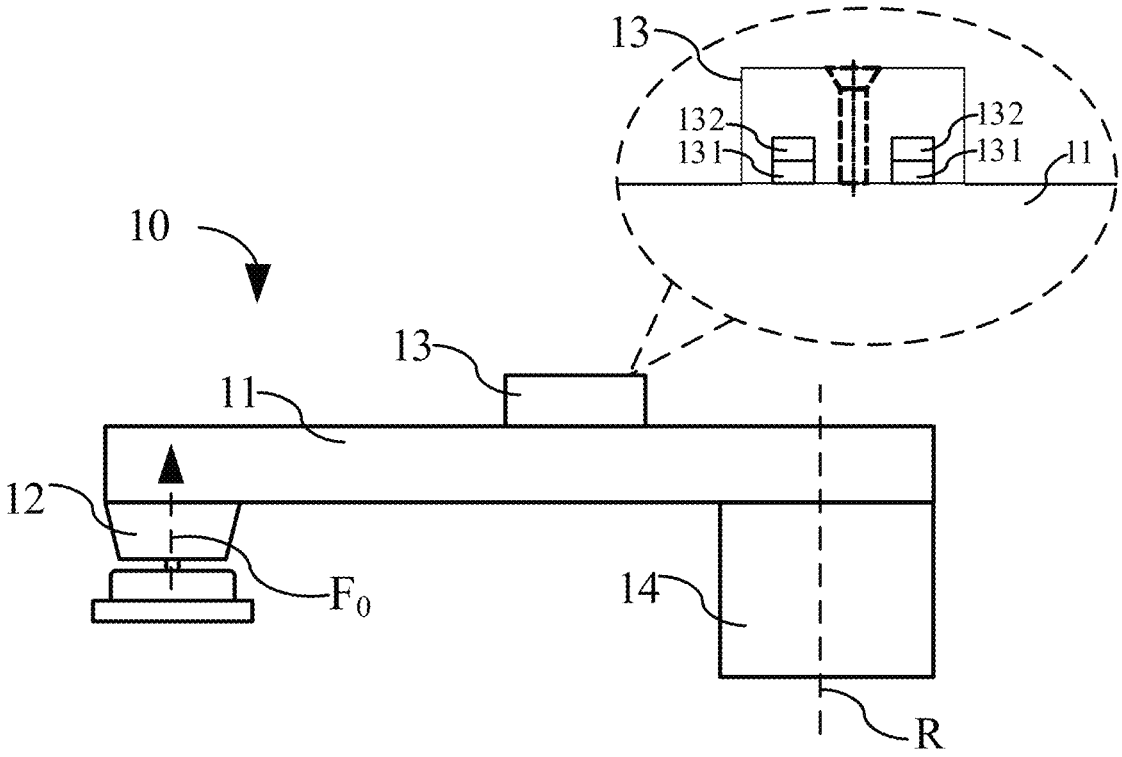
FIG. 2 is a schematic diagram of a structure of a conditioner according to an embodiment of the present disclosure.

The strain data of the conditioner may include a strain value of the strain generated by the drive arm, and the strain value may be measured by a strain sensor such as a strain gauge. In some embodiments, as shown in FIG. 2, a conditioner 10 may include a drive arm 11 and a conditioning head 12, and a strain sensor 13 is installed on the drive arm. When the polishing pad is conditioned, the polishing pad generates a counteracting force Fo in FIG. 2 on the conditioning head 12, and a strain generated by the drive arm under the counteracting force Fo may be measured through a strain sensor, to monitor a conditioning process of the polishing pad.

The strain sensor may be the strain sensor 13 shown in FIG. 2. The strain sensor may include two sets of contact elements 131 and piezoelectric sensors 132. After the strain sensor is closely attached to the drive arm, when the drive arm generates a strain, a distance between the two contact elements 131 varies with the strain, and the two contact elements each generate a friction force acting on a corresponding piezoelectric sensor 132, so that the piezoelectric sensor 132 measures a strain value of the drive arm based on the friction force applied to the piezoelectric sensor. The piezoelectric sensor is a sensor that can detect a strain based on a force applied to it. For a specific principle of the piezoelectric sensor, refer to a related technology. Details are not described herein again.

S120: Determine a conditioning deviation based the strain data, wherein the conditioning deviation is used to indicate flatness of the polishing pad.

The amplitude of the force applied to the drive arm by the conditioning head is affected by the thickness of the polishing pad, thereby affecting the strain value. For example, when the polishing pad is worn abnormally, the thickness of the abnormal part of the polishing pad is abruptly changed, which renders the amplitude of the force applied to the drive arm by the conditioning head also abruptly changed. Finally, the strain value of the drive arm is abruptly changed.

In this embodiment of the present disclosure, a thickness deviation/change of different positions of the polishing pad may be detected based on a change of the strain data. Because the thickness deviation of different positions of the polishing pad may reflect the flatness of a surface of the polishing pad, the conditioning deviation can be determined based on the strain data.

S130: Determine a wear state of the polishing pad based on the conditioning deviation, and perform chemical mechanical polishing on the wafer.

To determine the wear state of the polishing pad based on the conditioning deviation, a preset deviation threshold indicating a wear abnormality may be set according to a flatness requirement of the polishing pad, and an absolute value of the conditioning deviation is compared with the deviation threshold to determine whether the wear state of the polishing pad is abnormal. For example, when the absolute value of the conditioning deviation is greater than the deviation threshold, it is considered that the wear state of the polishing pad is abnormal; and when the absolute value of the conditioning deviation is less than or equal to the deviation threshold, it is considered that the wear state of the polishing pad is normal. It should be understood that wear of the polishing pad may be wear caused by being conditioned, or may be wear caused when the polishing pad polishes the wafer.

In this embodiment of the present disclosure, the strain data of the conditioner is obtained in real time, the conditioning deviation of the polishing pad may be determined based on the change of the strain data, and the wear state of the polishing pad is determined based on the determined conditioning deviation, to implement monitoring of the polishing pad. A case in which the polishing pad is abnormally worn can be alerted in a timely manner when the polishing pad is conditioned, to prevent a polishing effect of the wafer from being affected by abnormal conditioning of the polishing pad.

In some embodiments, the strain data includes a plurality of strain values of the drive arm that are continuously collected in a process of conditioning the polishing pad by the conditioning head. In this case, determining the conditioning deviation based on the strain data includes: determining the conditioning deviation based on the plurality of strain values included in the strain data.

It should be noted that a quantity of strain values included in the strain data used for determining the conditioning deviation cannot be too large, to prevent a polishing pad position corresponding to a previous strain value from overlapping a polishing pad position corresponding to a subsequent strain value.

Because collection times and collection positions between the continuously collected strain values are close to each other, the theoretical values of the strain values should be close to each other, and the changes between the continuously collected strain values can reflect the amplitude of the conditioning deviation readily. Therefore, in this embodiment of the present disclosure, by collecting the plurality of strain values continuously measured by the strain sensor and determining the conditioning deviation based on the plurality of strain values, the trimming deviation of the polishing pad can be more accurately determined by using the plurality of continuously collected strain values.

In some optional implementations, in the process of conditioning the polishing pad by the conditioning head, the drive arm drives the conditioning head to oscillate on the polishing pad, and the strain data includes a plurality of strain values collected in one oscillation cycle of the drive arm.

In a feasible implementation, as shown in FIG. 2, the drive arm 11 may rotate around an axis R of a base 14, to drive the conditioning head to oscillate on the polishing pad, so that different positions on the polishing pad can be conditioned. While in oscillatory motion, the drive arm may enable the polishing pad to rotate, so that the conditioning head can condition the different positions of the polishing pad in a better way.

In this embodiment of the present disclosure, in the process of conditioning the polishing pad by the conditioning head, the drive arm drives the conditioning head to oscillate on the polishing pad, so that different positions of the polishing pad can be evenly conditioned. In addition, the strain data includes the plurality of strain values of the drive arm that are continuously collected in the process of conditioning the polishing pad by the conditioning head, so that a plurality of strain values collected by the drive arm in one oscillation cycle of the drive arm may be used as strain data. Therefore, when the plurality of strain values are collected, the conditioning head is located at different positions of the polishing pad as much as possible, to avoid overlapping of polishing pad positions that correspond to the plurality of strain values, thereby ensuring validity of the conditioning deviation determined based on the plurality of strain values.

Figure 3:
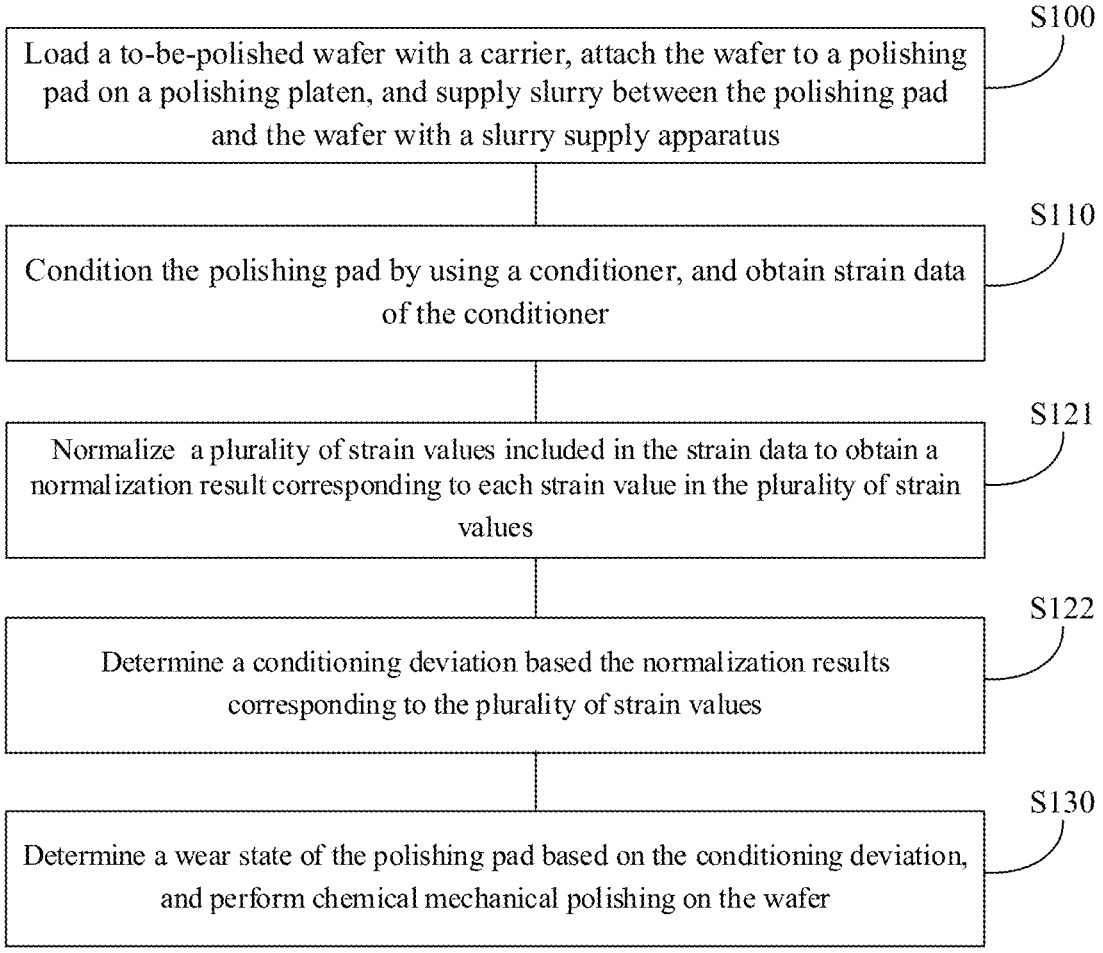
FIG. 3 is another step flowchart of a monitoring method for chemical mechanical polishing according to an embodiment of the present disclosure.

As shown in FIG. 3, in some embodiments, the monitoring method for chemical mechanical polishing includes:

S100: Load a to-be-polished wafer by using the carrier, attach the wafer to a polishing pad on a polishing platen, and supply slurry between the polishing pad and the wafer with a slurry supply apparatus.

S110: Condition the polishing pad by using a conditioner, and obtain strain data of the conditioner.

S121: normalizing a plurality of strain values included in the strain data, to obtain the normalization result corresponding to each strain value in the plurality of strain values.

In this embodiment of the present disclosure, the normalizing the plurality of strain values included in the strain data may be understood as mapping a difference between each strain value and a reference strain value to a unit interval [0, 1], to more significantly represent differences between the strain values. The reference strain value may be a minimum value or a maximum value in the plurality of strain values.

In some embodiments, the normalization result corresponding to the strain value may be calculated through the following formula based on the strain value included in the strain data:

$$\varepsilon_i^* = (\varepsilon_i - \varepsilon_\min)/(\varepsilon_\max - \varepsilon_\min) \quad \text{Formula 1}$$

In the formula, ε_i is an $i^{th}$ strain value included in the strain data, ε_i* is the normalization result of ε_i, ε_min is a minimum strain value in the plurality of strain values, ε_max is a maximum strain value in the plurality of strain values, and i is a positive integer.

Figure 4:
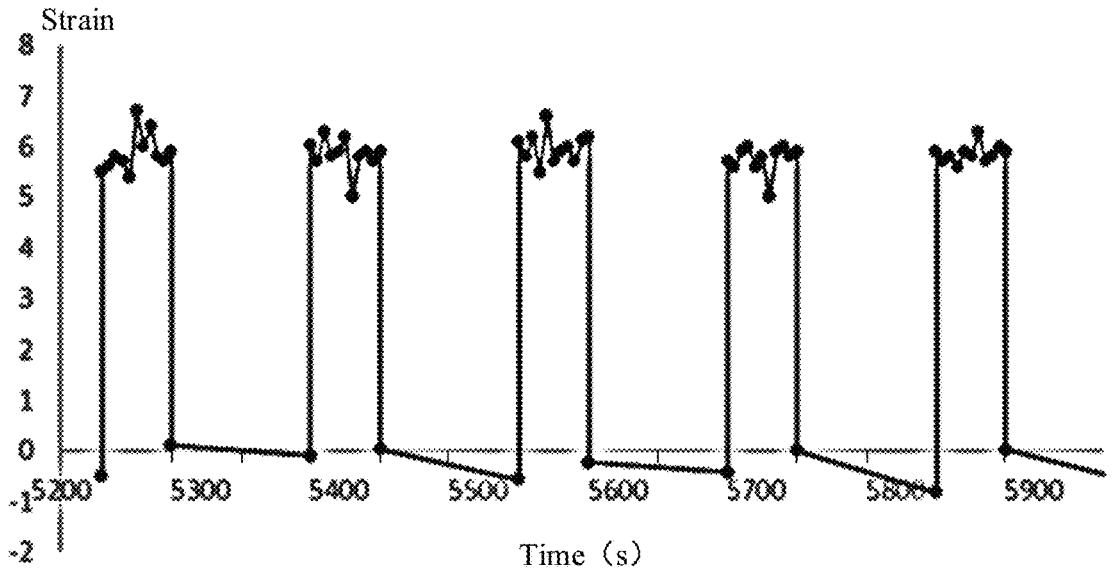
FIG. 4 is a record diagram of strain data according to an embodiment of the present disclosure.
Figure 5:
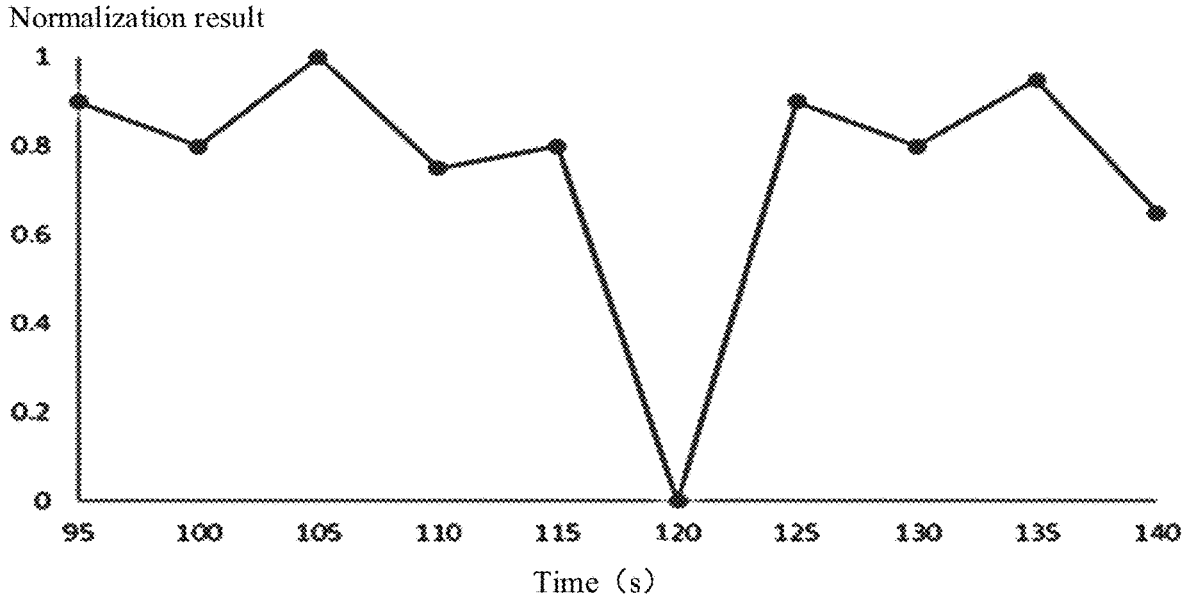
FIG. 5 is a record diagram of normalization results according to an embodiment of the present disclosure.
Figure 6:
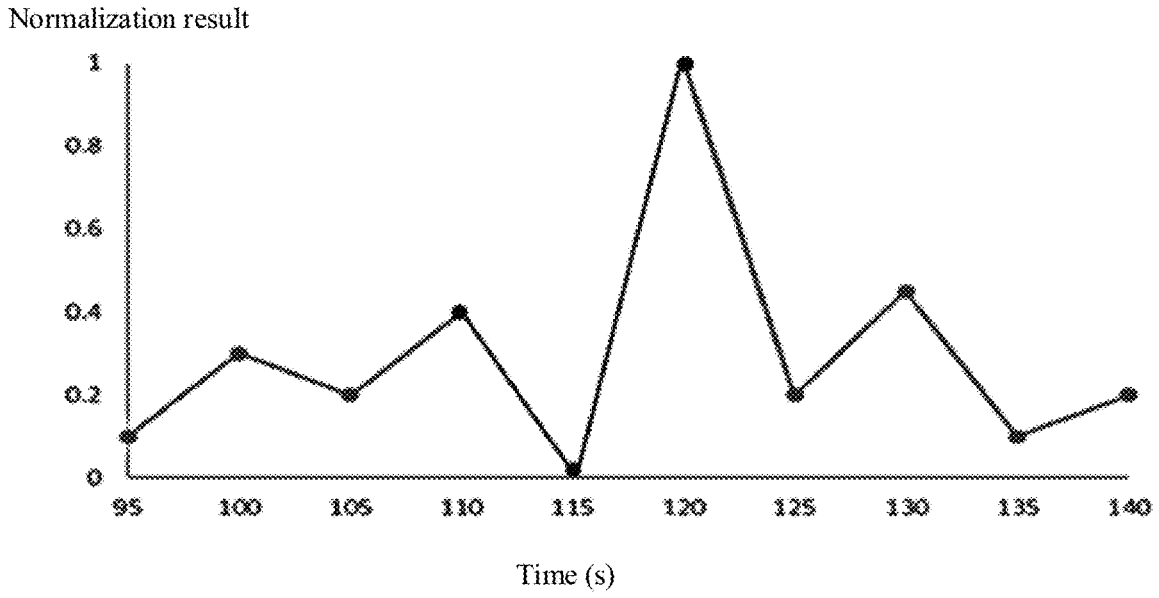
FIG. 6 is another record diagram of normalization results according to an embodiment of the present disclosure.

In an embodiment, partial strain data shown in FIG. 4 is obtained, horizontal coordinates in FIG. 4 are collection time points, vertical coordinates are collected strain values, and FIG. 4 shows a plurality of oscillation cycles of the drive arm. A case in which the wear state of the polishing pad is abnormal includes local overwear and local underwear. FIG. 5 shows normalization results of a group of strain data corresponding to the local overwear case. FIG. 6 shows normalization results of a group of strain data corresponding to the local underwear case. Both FIG. 5 and FIG. 6 correspond to one oscillation cycle.

It can be learned from FIG. 5 and FIG. 6 that, calculating the normalization result corresponding to the strain value through formula 1 causes the normalization results of the strain values to have relatively considerable differences, so that the thickness deviation of the polishing pad can be better indicated. Therefore, by calculating the normalization result corresponding to the strain value based on formula 1, the conditioning deviation of the polishing pad can be accurately determined.

S122: Determine the conditioning deviation based normalization results corresponding to the plurality of strain values.

For example, the conditioning deviation may be a difference between an average value of the normalization results of the plurality of strain values and a reference value.

In some embodiments, the conditioning deviation may be calculated through the following formula based on the normalization results corresponding to the plurality of strain values:

$$R = \sum_{i=1}^{n} (\varepsilon_i * / n - 0.5) \quad \text{Formula 2}$$

In the formula, R is the conditioning deviation, and n is a quantity of the strain values included in the strain data.

In this embodiment of the present disclosure, the conditioning deviation may be simply and conveniently obtained through Formula 2 based on the normalization results corresponding to the plurality of strain values, which helps improve calculation efficiency of the conditioning deviation.

In a feasible implementation, a deviation threshold may be set based on an initial flatness M0 of the polishing pad when the polishing pad is not used. For example, the deviation threshold may be set to $\mu M_0$, where u is a conversion coefficient, and a value of μ is related to performance and a process condition of the polishing pad and may be determined by measuring a related sample. For the conditioning deviation calculated through Formula 1 and Formula 2, u may generally be a value of 0.5-1.

It should be understood that the flatness of the polishing pad is a deviation of an actually measured surface height of the polishing pad from an ideal plane. The ideal plane is an analog plane calculated and fitted by using actually measured data. For a specific measurement method of the flatness of the polishing pad, reference may be made to a related technology, and details are not described herein again.

S130: Determine a wear state of the polishing pad based on the conditioning deviation, and perform chemical mechanical polishing on the wafer.

In this embodiment of the present disclosure, by normalizing the plurality of strain values included in the strain data, a difference between the plurality of strain values can be made more significant, so that the thickness deviation of different positions of the polishing pad is better represented by the normalization result. Therefore, a more accurate conditioning deviation can be determined based on the normalization results corresponding to the plurality of strain values.

In some embodiments, the monitoring method for chemical mechanical polishing provided in the present disclosure further includes: when at least one strain value included in strain data is less than an alert threshold, determining that the polishing pad is approaching end of service life.

Figure 7:
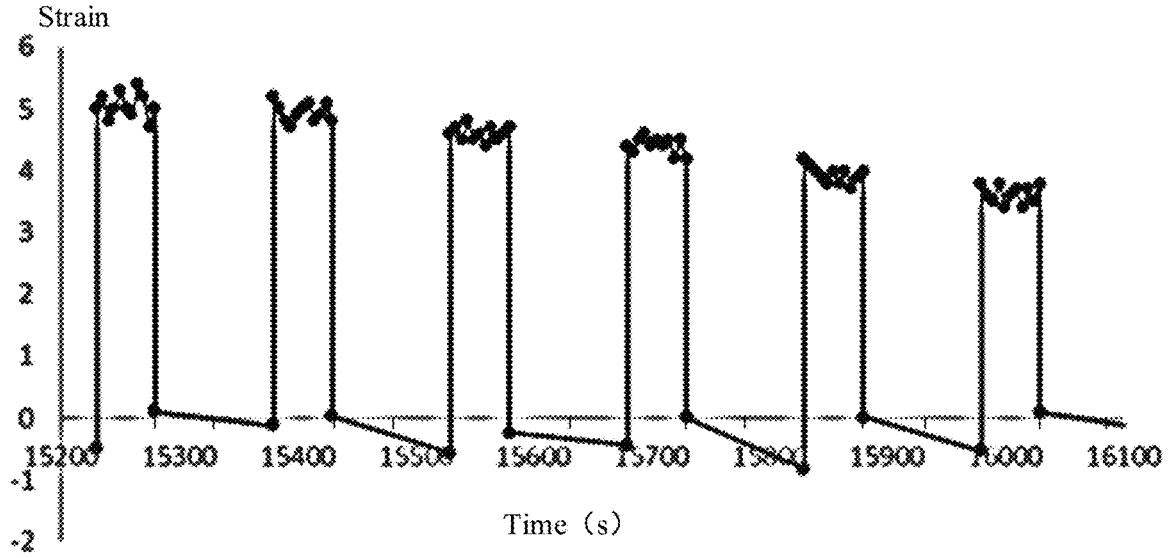
FIG. 7 is another record diagram of strain data according to an embodiment of the present disclosure.

As shown in FIG. 7, by monitoring the polishing pad, it is found that, under continuous polishing of the polishing pad by the conditioner, as the thickness of the polishing pad decreases, the strain value of the drive arm gradually decreases, that is, there is a positive correlation between the strain value of the drive arm and the thickness of the polishing pad. Therefore, in this embodiment of the present disclosure, an alert threshold for the strain value of the drive arm may be set, and the alert threshold indicates that the polishing pad is approaching/nearing end of service life. The alert threshold may be determined based on the strain value of the drive arm when the polishing pad is approaching end of service life. It should be understood that the alert threshold should not be less than a strain value of the drive arm when the polishing pad reaches the end of the service life. Therefore, in some embodiments, it may be determined that the polishing pad is approaching end of service life when the strain value of the drive arm is less than the alert threshold; and it may be determined that the polishing pad is approaching end of service life when the strain value of the drive arm is not less than the alert threshold.

In this embodiment of the present disclosure, by setting the alert threshold, when at least one strain value included in the strain data is less than the alert threshold, it is determined that the polishing pad is approaching end of service life, and a reminder can be given when the polishing pad is approaching end of service life, so that the polishing pad can be replaced in a timely manner, to avoid a decrease in production efficiency due to the polishing pad reaching the end of its service life.

In some embodiments, the polishing monitoring method provided in this embodiment of the present disclosure further includes: calculating the alert threshold through the following formula based on a driving force that is output by a drive mechanism in the process of conditioning the polishing pad by the conditioning head and strock resistance acted on the conditioning plate in the conditioning head at the maximum travel distance:

$$\varepsilon_y=(P-f(L_\max))/k \quad \text{Formula 3}$$

In the formula, ε y is the alert threshold, P is the driving force that is output by the drive mechanism in the process of conditioning the polishing pad by the conditioning head, f(L_max) is the travel resistance acted on the conditioning plate at the maximum travel distance, L_max the maximum travel distance of the conditioning plate, and k is a correlation coefficient between the strain value and a pressure exerted by the conditioning plate on the polishing pad. In this embodiment of the present disclosure, the conditioning plate can be stretched between the polishing pad and the drive arm, to compress the polishing pad, and a stretching range is a stroke range of the conditioning plate.

The pressure F exerted by the conditioning plate on the polishing pad can be calculated through the following formula:

$$F=P-f(L) \quad \text{Formula 4}$$

Figure 8:
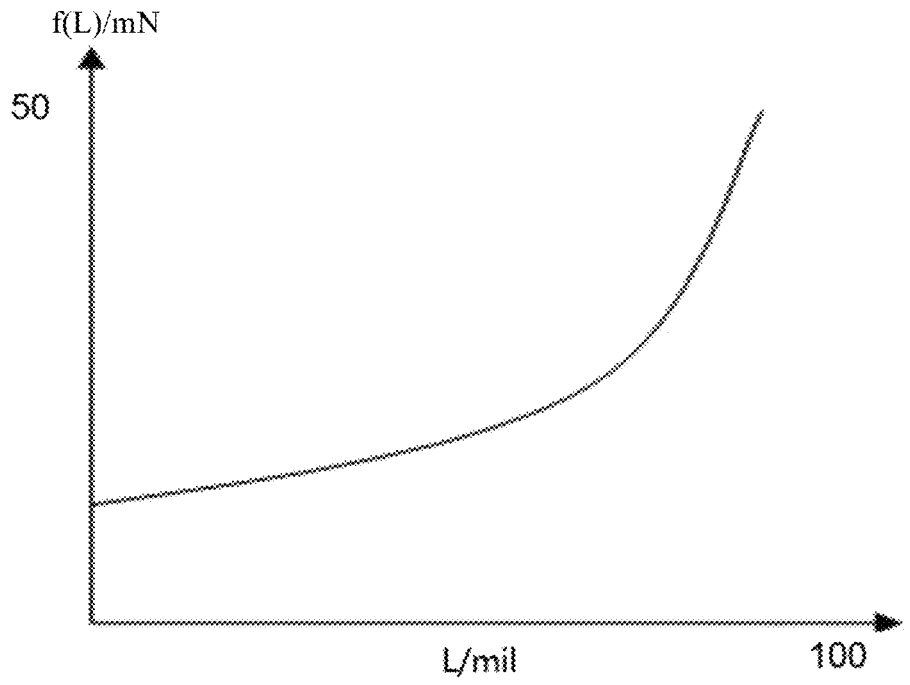
FIG. 8 is a schematic diagram of a correlation between a travel resistance and a travel distance of a conditioning plate according to an embodiment of the present disclosure.

In the formula, L is a stroke of the conditioning plate, and $L=L_{max}+d_{min}-d$, where $d_{min}$ is a thickness of the polishing pad when the polishing pad reaches the end of its service life, and d is an actual thickness of the polishing pad; f(L) is the travel resistance acted on the conditioning plate; for a schematic diagram of a correlation between f(L) and L, refer to FIG. 8; in FIG. 8, a horizontal coordinate unit is mil (milli-inch), and a vertical coordinate unit is mN (millinewton); and a specific expression of f(L) may be obtained by fitting actually measured data, or may be obtained in another suitable manner. This is not limited in this embodiment of the present disclosure.

k may be obtained by fitting a correlation between F and the drive arm. For example, in some embodiments, strain values of the drive arm may be sequentially measured when an actual pressure F is 2-10 lbf, and a measurement interval is 0.5 lbf. A pressure-strain curve is obtained after fitting, and the foregoing correlation coefficient k may be obtained by fitting the curve by using $F=k*\varepsilon$. The measurement interval and measurement precision can be set according to actual requirements. A larger the measurement interval and a smaller the interval indicate a more accurate curve fitting result.

In this embodiment of the present disclosure, the alert threshold can be calculated through Formula 3 based on a correlation between the strain value and the pressure exerted by the conditioning plate on the polishing pad, the driving force that is output by the drive mechanism in the process of conditioning the polishing pad by the conditioning head, and the travel resistance acted on the conditioning plate at the maximum travel distance. The alert threshold can be readily and conveniently determined without using a complex hardware facility, so that monitoring complexity can be effectively reduced.

According to a second aspect of the embodiments of the present disclosure, a conditioning system is provided, including a conditioner, a strain sensor disposed on a drive arm of the conditioner, and a controller. The controller is configured to execute the method in any one of the foregoing embodiments based on strain data of the strain sensor.

The controller may include a processor and a computer program. When the processor runs the computer program, the conditioner may be enabled to perform operations corresponding to any method in the foregoing method embodiments.

The conditioning system in this embodiment is based on a same invention concept as the foregoing embodiments of the monitoring method for chemical mechanical polishing, is configured to implement the corresponding monitoring method for chemical mechanical polishing in the foregoing method embodiments, and has beneficial effects of corresponding method embodiments. Details are not described herein again. In addition, for function implementation of all units in the conditioning system in this embodiment, refer to descriptions of corresponding parts in the foregoing method embodiments. Details are not described herein again.

Figure 9:
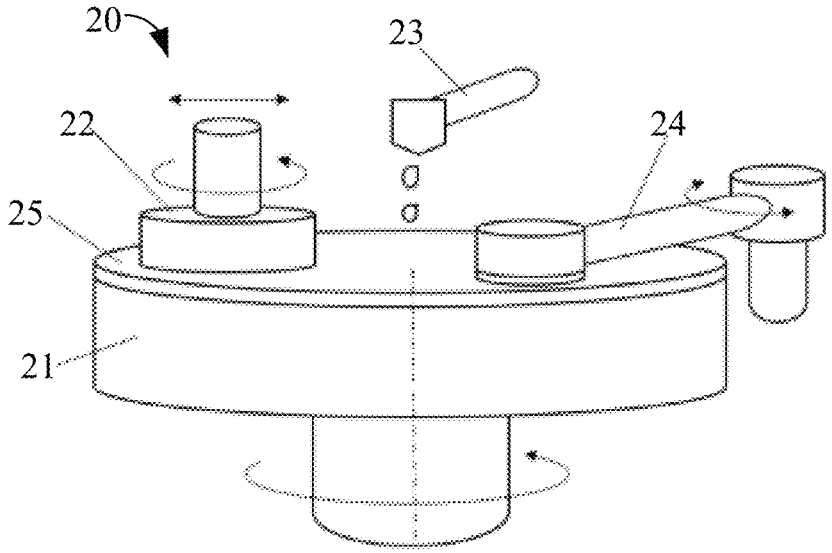
FIG. 9 is a schematic diagram of a structure of a chemical mechanical polishing device according to an embodiment of the present disclosure.

As shown in FIG. 9, according to a third aspect of the embodiments of the present disclosure, a chemical mechanical polishing device 20 is further provided, including a polishing platen 21, a carrier 22, a slurry supply apparatus 23, a conditioner 24, and a controller. The carrier 22 loads a to-be-polished wafer and attaches the wafer to a polishing pad 25 on the polishing platen 21, the slurry supply apparatus 23 supplies slurry between the polishing pad 25 and the wafer, the conditioner 24 is configured to condition a surface of the polishing pad 25, and the controller is configured to execute the method in any one of the foregoing embodiments.

Chemical mechanical polishing (CMP) is also referred to as chemical mechanical planarization (CMP), and is a global planarization processing technology for ultra-precision surfaces, which can make chemical mechanical polishing of a wafer be completed under a chemical and mechanical joint action.

In the chemical mechanical polishing device in this embodiment of the present disclosure, the polishing pad 25 is disposed on the polishing platen 21, and the carrier 22 and the conditioner 24 may be respectively located on two sides of the polishing pad 25, so that when the carrier 22 polishes the wafer through the polishing pad 25, a conditioning plate of the conditioner 24 can simultaneously condition and monitor the polishing pad 25.

It should be understood that the chemical mechanical polishing device in this embodiment is based on a same invention concept as the embodiments of the foregoing monitoring method for chemical mechanical polishing and the conditioning system. For a specific implementation and beneficial effects of the chemical mechanical polishing device, reference may be made to the foregoing embodiments, and details are not described herein again.

It should be noted that, according to an implementation requirement, the components/steps described in the embodiments of this disclosure may be split into more components/steps, or two or more components/steps or the components/some operations of the steps may be combined into new components/steps, to implement the objectives of the embodiments of this disclosure.

The foregoing method according to the embodiments of the present disclosure may be implemented in hardware or firmware, or is implemented as software or computer code that may be stored in a recording medium (such as a CD-ROM, a RAM, a floppy disk, a hard disk, or a magneto-optical disk), or is implemented as computer code that is downloaded through a network and originally stored in a remote recording medium or a non-temporary machine-readable medium and that is to be stored in a local recording medium. Therefore, the method described herein may be processed by such software stored on a recording medium that uses a general-purpose computer, a dedicated processor, or a programmable or dedicated hardware (such as an application specific integrated circuit (ASIC) or a field programmable gate array (FPGA)). It may be understood that a computer, a processor, a microprocessor controller, or programmable hardware includes a storage component that can store or receive software or computer code (for example, a random access memory (RAM), a read-only memory (ROM), or a flash memory). When the software or computer code is accessed and executed by the computer, the processor, or hardware, the method described herein is implemented. In addition, when a general-purpose computer accesses the code for implementing the method shown herein, execution of the code converts the general-purpose computer into a special-purpose computer for executing the method shown herein.

A person of ordinary skill in the art may be aware that the units and the method steps in the examples described with reference to the embodiments disclosed in this specification can be implemented by using electronic hardware or a combination of computer software and electronic hardware. Whether these functions are implemented by hardware or software depends on particular applications and design constraints of the technical solutions. A person skilled in the art may implement the described functions for each particular application by using different methods, but such implementation should not be considered beyond the scope of the embodiments of the present disclosure.

What is claimed is:

1. A monitoring method for chemical mechanical polishing, comprising:

loading a to-be-polished wafer with a carrier, attaching the wafer to a polishing pad on a polishing platen, and supplying slurry between the polishing pad and the wafer with a slurry supply apparatus;

conditioning the polishing pad with a conditioner, and obtaining strain data of the conditioner, wherein the conditioner comprises a drive arm and a conditioning head, the conditioning head is configured to condition the polishing pad with the support of the drive arm, the drive arm undergoes a strain in response to a force applied by the conditioning head, the strain data is indicative of a strain value of the drive arm, and the strain data comprises a plurality of strain values of the drive arm that are continuously collected in a process of conditioning the polishing pad with the conditioning head;

determining a conditioning deviation based on the strain data, wherein the conditioning deviation is used to indicate flatness of the polishing pad;

determining a wear state of the polishing pad based on the conditioning deviation, and performing chemical mechanical polishing on the wafer, wherein the strain values comprised in the strain data are compared with an alert threshold, and when at least one of the strain values comprised in the strain data is less than the alert threshold, an alert signals that the polishing pad is approaching end of service life, wherein the alert threshold is calculated through the following formula:

$$\varepsilon_y=(P-f(L_\max))/k$$

where, in the formula, ε_y is the alert threshold, P is a driving force that is output by a drive mechanism in the process of conditioning the polishing pad by the conditioning head, f(L_max) is a travel resistance acted on a conditioning plate of the conditioning head at a maximum travel distance of the conditioning plate, L_max is the maximum travel distance of the conditioning plate, and k is a correlation coefficient between the strain value and a pressure exerted by the conditioning plate on the polishing pad.

2. The method according to claim 1, wherein the determining the conditioning deviation based on the strain data comprises determining the conditioning deviation based on the plurality of strain values comprised in the strain data.

3. The method according to claim 2, wherein in the process of conditioning the polishing pad by the conditioning head, the drive arm drives the conditioning head to oscillate on the polishing pad, and the strain data comprises a plurality of strain values collected in one oscillation cycle of the drive arm.

4. The method according to claim 3, wherein the determining the conditioning deviation based on the plurality of strain values comprised in the strain data comprises:

normalizing the plurality of strain values comprised in the strain data to obtain the normalization result corresponding to each strain value in the plurality of strain values; and determining the conditioning deviation based on normalization results corresponding to the plurality of strain values.

5. The method according to claim 4, wherein the normalizing the plurality of strain values comprised in the strain data to obtain the normalization result corresponding to each strain value in the plurality of strain values comprises:

calculating, based on the strain value comprised in the strain data, the normalization result corresponding to each strain value in the plurality of strain values through the following formula:

$$\varepsilon i^*=(\varepsilon_i-\varepsilon_\min)/(\varepsilon_\max-\varepsilon_\min)$$

where, in the formula, ε_i is an $i^{th}$ strain value comprised in the strain data, ε_i* is the normalization result of ε_i, ε_min is a minimum strain value in the plurality of strain values, ε_max is a maximum strain value in the plurality of strain values, and i is a positive integer.

6. The method according to claim 2, wherein the determining the conditioning deviation based on the plurality of strain values comprised in the strain data comprises:

normalizing the plurality of strain values comprised in the strain data, to obtain the normalization result corresponding to each strain value in the plurality of strain values; and determining the conditioning deviation based on the normalization results corresponding to the plurality of strain values.

7. The method according to claim 6, wherein the normalizing the plurality of strain values comprised in the strain data to obtain the normalization result corresponding to each strain value in the plurality of strain values comprises:

calculating, based on the strain value comprised in the strain data, the normalization result corresponding to each strain value in the plurality of strain values through the following formula:

where, in the formula, ε_i is an $i^{th}$ strain value comprised in the strain data, ε_i* is the normalization result of ε_i, ε_min is a minimum strain value in the plurality of strain values, ε_max is a maximum strain value in the plurality of strain values, and i is a positive integer.

8. The method according to claim 7, wherein the determining the conditioning deviation based on normalization results corresponding to the plurality of strain values comprises:

calculating the conditioning deviation through the following formula:

$$R = \sum_{i=1}^{n} (\varepsilon_i * / n - 0.5)$$

where, in the formula, R is the conditioning deviation, and n is a quantity of the plurality of strain values comprised in the strain data.

9. A chemical mechanical polishing device, comprising: a polishing platen, a carrier, a slurry supply apparatus, a conditioner, and a controller, wherein the carrier is configured to load a to-be-polished wafer and attach the wafer to a polishing pad on a polishing platen, the slurry supply apparatus is configured to supply slurry between the polishing pad and the wafer, the conditioner is configured to condition a surface of the polishing pad, and the controller is configured to execute a monitoring method for chemical mechanical polishing, the method comprising:

loading a to-be-polished wafer with a carrier, attaching the wafer to a polishing pad on a polishing platen, and supplying slurry between the polishing pad and the wafer with a slurry supply apparatus;

conditioning the polishing pad with a conditioner, and obtaining strain data of the conditioner, wherein the conditioner comprises a drive arm and a conditioning head, the conditioning head is configured to condition the polishing pad with the support of the drive arm, the drive arm undergoes a strain in response to a force applied by the conditioning head, the strain data is indicative of a strain value of the drive arm, and the strain data comprises a plurality of strain values of the drive arm that are continuously collected in a process of conditioning the polishing pad with the conditioning head;

determining a conditioning deviation based on the strain data, wherein the conditioning deviation is used to indicate flatness of the polishing pad;

determining a wear state of the polishing pad based on the conditioning deviation, and performing chemical mechanical polishing on the wafer [; and], wherein the strain values comprised in the strain data are compared with an alert threshold, and when at least one of the strain values comprised in the strain data is less than the alert threshold, an alert signals that the polishing pad is approaching end of service life, wherein the alert threshold is calculated through the following formula:

$$\varepsilon_y = (P - f(L_max))/k$$

where, in the formula, ε_y is the alert threshold, P is a driving force that is output by a drive mechanism in the process of conditioning the polishing pad by the conditioning head, f(L_max) is a travel resistance acted on a conditioning plate of the conditioning head at a maximum travel distance of the conditioning plate, L_max is the maximum travel distance of the conditioning plate, and k is a correlation coefficient between the strain value and a pressure exerted by the conditioning plate on the polishing pad.

10. The device according to claim 9, wherein in the process of conditioning the polishing pad by the conditioning head, the drive arm drives the conditioning head to oscillate on the polishing pad, and the strain data comprises the plurality of strain values collected in one oscillation cycle of the drive arm.

11. The device according to claim 10, wherein the determining the conditioning deviation based on the plurality of strain values comprised in the strain data comprises:

normalizing the plurality of strain values comprised in the strain data, to obtain the normalization result corresponding to each strain value in the plurality of strain values; and determining the conditioning deviation based on normalization results corresponding to the plurality of strain values.

12. The device according to claim 11, wherein the normalizing the plurality of strain values comprised in the strain data, to obtain the normalization result corresponding to each strain value in the plurality of strain values comprises:

calculating, based on the strain value comprised in the strain data, the normalization result corresponding to each strain value in the plurality of strain values through the following formula:

$$\varepsilon_i^* = (\varepsilon_i - \varepsilon_min)/(\varepsilon_max - \varepsilon_min)$$

where, in the formula, ε_i is an $i^{th}$ strain value comprised in the strain data, ε_i* is the normalization result of ε_i, ε_min is a minimum strain value in the plurality of strain values, ε_max is a maximum strain value in the plurality of strain values, and i is a positive integer.

13. The device according to claim 9, wherein the determining the conditioning deviation based on the strain data comprises determining the conditioning deviation based on the plurality of strain values comprised in the strain data.

14. The device according to claim 13, wherein the determining the conditioning deviation based on the plurality of strain values comprised in the strain data comprises:

normalizing the plurality of strain values comprised in the strain data, to obtain the normalization result corresponding to each strain value in the plurality of strain values; and determining the conditioning deviation based on normalization results corresponding to the plurality of strain values.

15. The device according to claim 14, wherein the normalizing the plurality of strain values comprised in the strain data, to obtain the normalization result corresponding to each strain value in the plurality of strain values comprises:

calculating, based on the strain value comprised in the strain data, the normalization result corresponding to each strain value in the plurality of strain values through the following formula:

$$\varepsilon i^* = (\varepsilon i - \varepsilon_min)/(\varepsilon_max - \varepsilon_min)$$

where, in the formula, ε_i is an $i^{th}$ strain value comprised in the strain data, ε_i* is the normalization result of ε_i, ε_min is a minimum strain value in the plurality of strain values, ε_max is a maximum strain value in the plurality of strain values, and i is a positive integer.

16. The device according to claim 15, wherein the determining the conditioning deviation based on normalization results corresponding to the plurality of strain values comprises:

calculating the conditioning deviation through the following formula:

$$R = \sum_{i=1}^{n} (\varepsilon_i * / n - 0.5)$$

where, in the formula, R is the conditioning deviation, and n is a quantity of the plurality of strain values comprised in the strain data.

* * * * *